US005722175A

United States Patent [19]

Slates

[11] Patent Number: 5,722,175

[45] Date of Patent: Mar. 3, 1998

[54] SIGHT DEVICE ADJUSTMENT MOUNT

[75] Inventor: Scott O. Slates, Wentzville, Mo.

[73] Assignee: Toxonics Manufacturing, Inc., Wentzville, Mo.

[21] Appl. No.: 629,999

[22] Filed: Jul. 8, 1996

[51] Int. Cl.[6] ..... F41G 1/467

[52] U.S. Cl. ..... 033/265; 124/87

[58] Field of Search ..... 33/265, 247, 248, 33/249, 252, 254, 257, 258; 124/87

[56] References Cited

U.S. PATENT DOCUMENTS

| | | | |
|---|---|---|---|
| 3,854,217 | 12/1974 | Killian | 33/265 |
| 3,864,836 | 2/1975 | Haines | 33/265 |
| 3,871,105 | 3/1975 | Brougham | 33/265 |
| 4,020,560 | 5/1977 | Heck | 33/265 |
| 4,317,288 | 3/1982 | Yasui | 33/265 |
| 4,757,614 | 7/1988 | Kudlacek | 33/265 |
| 4,761,888 | 8/1988 | Kudlacek | 33/265 |
| 4,819,611 | 4/1989 | Sappington | 33/265 |
| 4,875,290 | 10/1989 | Finch | 33/265 |
| 5,001,837 | 3/1991 | Bray | 33/265 |
| 5,072,716 | 12/1991 | Sappington | 124/87 |
| 5,174,269 | 12/1992 | Sappington | 124/87 |
| 5,228,204 | 7/1993 | Khoshnood | 33/265 |
| 5,289,814 | 3/1994 | Maisano | 124/87 |
| 5,379,746 | 1/1995 | Sappington | 124/87 |
| 5,384,966 | 1/1995 | Gibbs | 33/265 |
| 5,414,936 | 5/1995 | Sappington | 33/265 |
| 5,428,901 | 7/1995 | Slates | 33/265 |
| 5,524,601 | 6/1996 | Slates et al. | 33/265 |

*Primary Examiner*—Christopher W. Fulton
*Attorney, Agent, or Firm*—Paul M. Denk

[57] ABSTRACT

An adjustable bow sighting device in which a hollow carrier body has a slot formed on the exterior with tracks and on the interior with slots, so a rotatable threaded shaft directed parallel to the interior slots can be engaged by the eye of an actuator which extend through a slide block mounted on the body tracks. The eye of the actuator is formed with threaded elements and on adjacent smooth surface to embrace the threaded shaft so that where the thread elements engage the shaft rotation of the shaft can move the slide block according to the displacement of the thread pitch. A resilient element on the actuator holds the eye engaged on the threaded shaft but can be operated to disengage the eye from the threaded shaft for gross slide block adjustments independent of the threaded shaft. Multipoint contact can be made between the various body tracks, the threaded shaft, the slide block, once the sighting device has been accurately focused, and tightened into position, to assure that fixation of the set sight is maintained even during repeat usage of the bow.

3 Claims, 2 Drawing Sheets

SIGHT DEVICE ADJUSTMENT MOUNT

This invention is directed to a bow sighting device which is manually adjustable either in micro steps or in significantly greater steps as desired.

The environment of the invention is depicted in my prior application, entitled "Bow Sight Mount For Absorbing the Forces of Shear," filed on Nov. 16, 1995, Ser. No. 08/558,712, now U.S. Pat. No. 5,644,849. In that application, structure is shown for obtaining accuracy in target and game shooting. It has been determined that such prior structure is not well adapted for game shooting when the game being sighted is moving in an upredicatable manner so that there is insignificant time to adjust for changes in distance to the target.

The present device is adapted for use either targeting a fixed object, or for use in connection with obtaining varied adjustments in game shooting where the target is alternatively briefly fixed and then moving so the distances changes that may be difficult to judge. In such situations, the sighting device can be at times adjusted for slight distances and at other times adjusted to accommodate significant sighting distances.

The essence, though, of this invention is that once the adjustable sight has been fixed into proper focus, and accurately adjusted for sighting indirectly onto a target, the various components of this device can be tightened, to provide for a multipoint securement of the sight with respect to its supporting bow, to assure that the sight remains fixed, during shooting of the arrow. Hence, vibrations, impact, and other abrupt movements encountered during usage of the bow, while shooting of an arrow, will not disrupt the setting of this adjustable mount, because of the firmness of its securement through a multipoint engagement of the sight, once adjusted, into a stationarily fixed position, or until such time as a subsequent resetting may be required.

SUMMARY OF THE INVENTION

In order to be able to condition a bow mounted sighting device for elective use in fixed target shooting or for game shooting of a moving target, it is a unique feature to be able to combine these different use conditions in the same sighting device.

Additionally, the invention is able to embody fine as well as coarse adjustments by using a single adjustment device to accomplish these different results.

It is a further object of the invention to combine a rotary shaft in a sighting device with a mechanism that is able to engage the rotary shaft for fine adjustments of the sight device, or to disengage the rotary shaft for coarse adjustments.

Still another object of this invention is to provide for at least a five point contact between the various engaging components that fix the adjusted sight into its set condition.

Other objects and advantages of the invention will be set forth in the disclosure of a preferred embodiment of the sight adjusting device.

DETAILED DESCRIPTION OF THE PREFERRED EMBODIMENT

Figure 1:
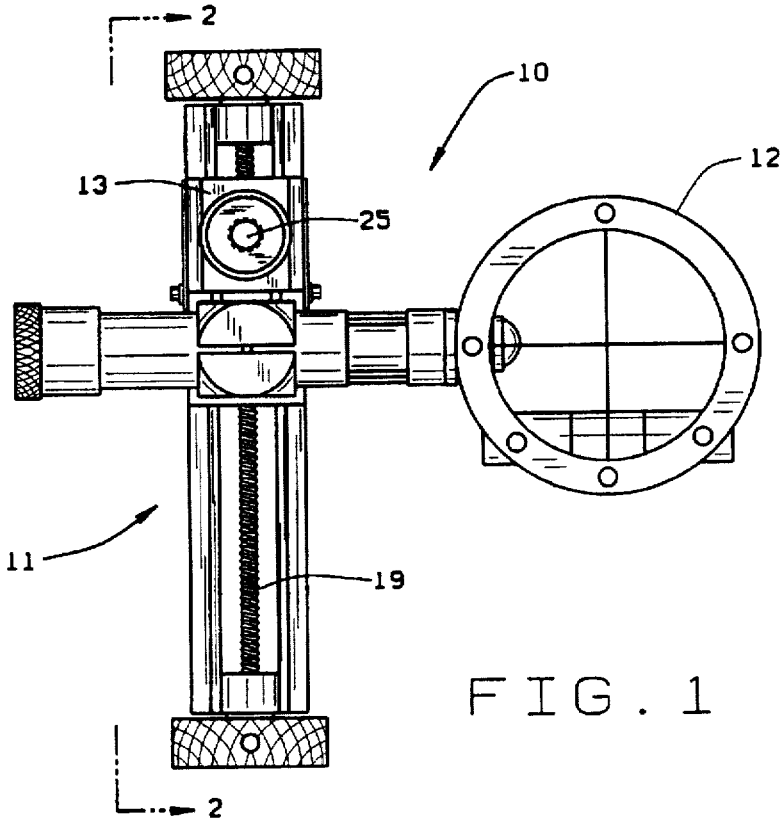
FIG. 1 is a front view of the sighting device.
Figure 2:
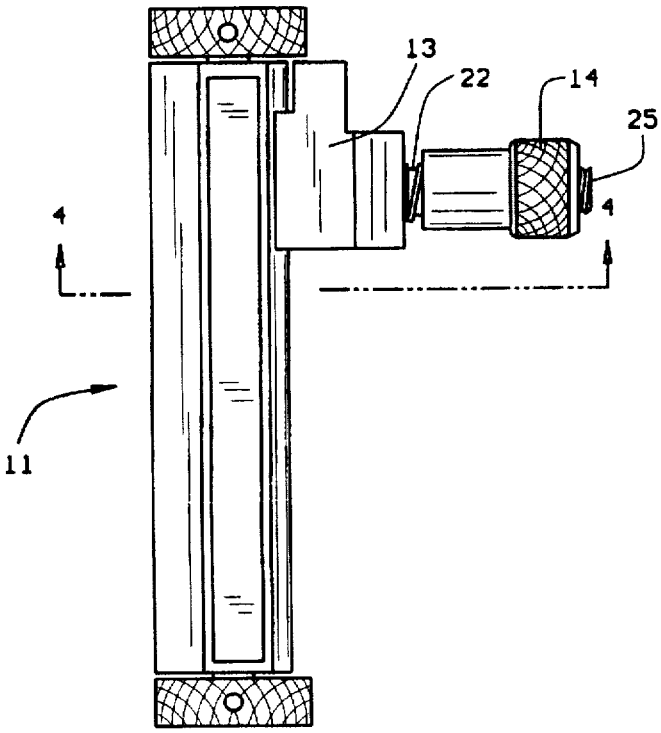
FIG. 2 is a side view along 2—2 in FIG. 1.

FIG. 1 is a vertical face view of the adjustable sighting device 10 illustrating certain of the several general components of the device associated with an elongated carrier 11 carrying a target sighting frame 12. That frame 12 is supported on a vertically movable block 13 which is slidable on the carrier 11 to afford relocation adjustment of the sighting frame 12. FIG. 2 is a vertical side view of the carrier 11 to show a slide block 13 carried upon a manual adjustable component or knob 14 for rapid vertical positioning of the block 13 which carries the sighting frame 12.

Figure 3:
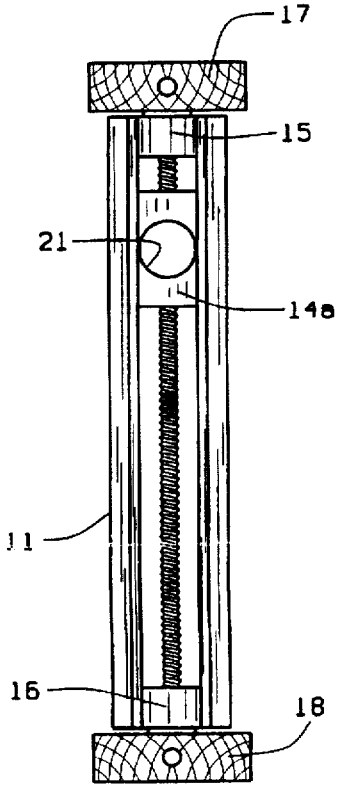
FIG. 3 is a face view of FIG. 2 with the sight removed.

FIG. 3 is a face or front view of the elongated carrier 11 with a vertical block 13 removed to reveal a slide plate **14*a* as part of a drive mechanism in the carrier 11 which comprises an elongated threaded shaft 19 mounted within the carrier 11 on stationary bearings 15 and at bearing 16 at the opposite ends. The shaft is adapted to be rotated by a first dial 17 adjacent one end of the carrier 11, or by a second dial 18 adjacent the second or bottom end of the carrier 11. Both of these dials are fixed to the threaded shaft 19, as by a set screw, or the like. The slide plate 14*a* is movable within slots 20 formed in the carrier 11, and the plate 14*a* is provided with an enlarged aperture 21. This plate is rather loosely located within said slots. The aperture 21 is designed to receive rather loosely the shaft 22, which extends therethrough, as can be seen. The back or inserted end of the shaft 22 includes an enlarged eye 23, which is designed for locating upon and surrounding the threaded shaft 19. The eye 23 is enlarged so that about one-half of the inner surface is formed with a threaded formation 24, as noted, which generally match the threads of the shaft 19, while the other surface 25** of the eye is left smooth, for a purpose to appear.

In order to permit fine positioning of the block 13 along the carrier 11, the shaft 22 is threaded on its outer end portion 25 to receive a spring actuated push sleeve 26 which is threaded on the shaft 22 so the spring 27 which is pushing on the sleeve 26 will lift the shaft eye to have the threaded portion 24 in the shaft eye 23 engaged with the threaded shaft 19 as at 24. When the spring engages on the push sleeve 26 the shaft 22 will be moved to engage the shaft 19 for enabling fine adjustment of the block 13 by turning either knob 17 or 18. When a rapid adjustment of the frame 12 is desired, the sleeve 26 can be pushed to move the eye 23 on the shaft 22 to disengage the eye 23 from the shaft 19 whereby the block 13 can be moved rapidly vertically independently of the shaft 19. This provides for a quick major adjustment for the sight.

Figure 5:
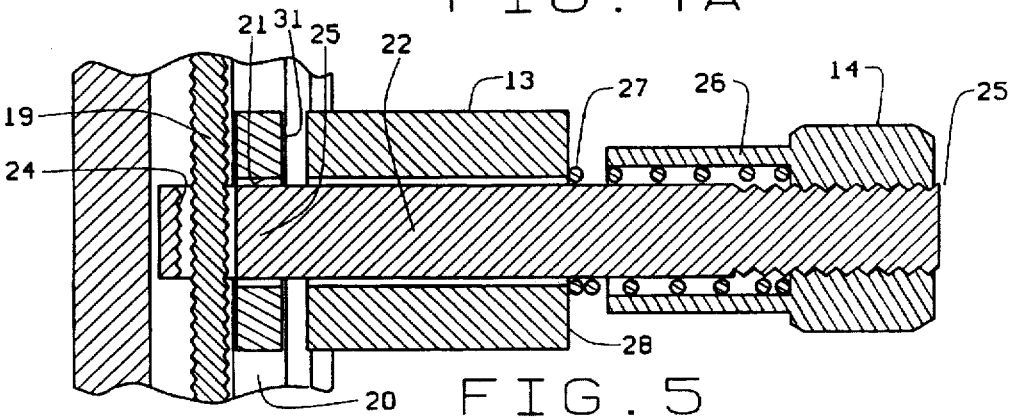
FIG. 5 is a section view along line 5—5 in FIG. 4 to show the mounting shaft disconnected from a longitudinal threaded shaft.
Figure 5A:
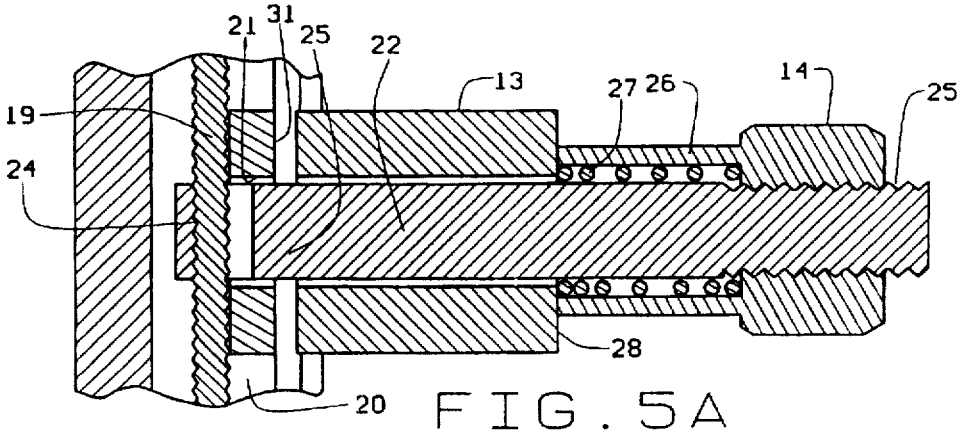
FIG. 5A is a section view also taken along line 5—5 to illustrate a position in which the mounting shaft is engaged with the threaded shaft.

Hence, when the sight is being provided with major adjustment, the manual adjustable component 14 is simply pushed inwardly, so as to provide clearance between its eye 23 and the threaded shaft 19, as can be seen in FIG. 5, to provide for rapid and major adjustment to the sight. But, when it is desired to provide for fine adjustment, the adjustable component or knob 14 is released, the spring biases the shaft 22 out of the mount, providing for an engagement between the threaded formation 24 of the formed eye 23, with the backside of the threaded shaft 19, so that when the threaded shaft is turned, through manipulation of the dials 17 or 18, a fine adjustment can be attained, as can be seen in FIG. 5A.

Figure 4:
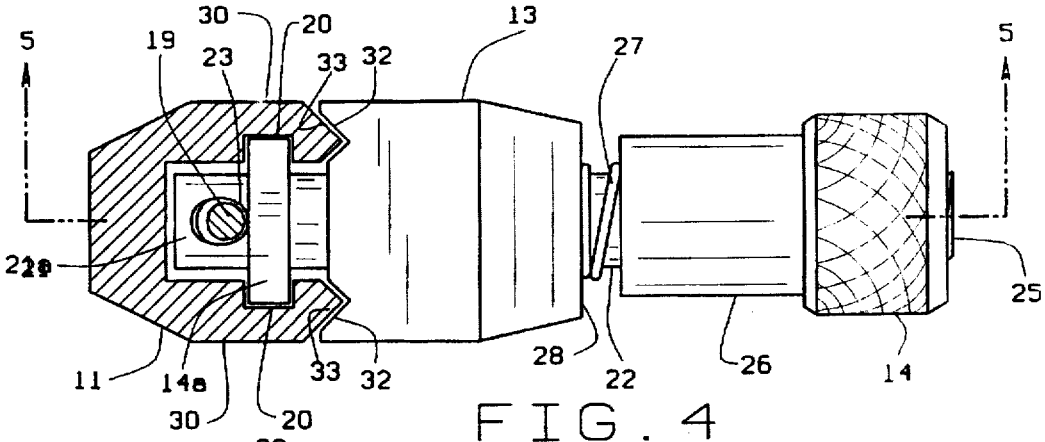
FIG. 4 is a transverse section view along line 4—4 in FIG. 2.
Figure 4A:
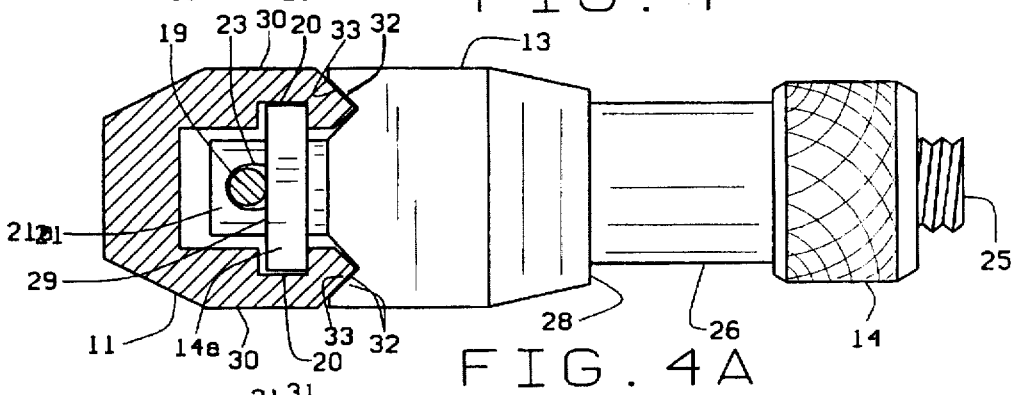
FIG. 4A is a transverse section view also taken along the line 4—4 in FIG. 2, showing the sight in its tightened condition.

The desired configuration for the carrier 11 is shown in FIG. 4 to show the plate 14*a* mounted in the slots 20 in the side walls 30 of the carrier. Furthermore, the normal position of the shaft end 21*a* is shown with the eye 23 held engaged with the shaft 19 by the spring loaded sleeve 26 forcing the eye 23 to engage said shaft 19.

As previously summarized, one of the primary objects of this invention is to provide for a multipoint contact within the sight mount structure so as to assure that it is firmly affixed in place, once finely adjusted. This is achieved when the sight has been finally adjusted to a very accurate setting. When that occurs, the adjustable knob 14 is further tightened upon the shaft 22. Thus, it eventually binds against the shoulder 28 of the movable block 13. In doing so, it can be seen that the shaft 22 will be pulled snuggly in a direction out of the carrier 11. When this occurs, the threaded formation 24 of the eye 23 snuggly pushes against the threaded shaft 19, and pulls it into engagement against the back surface 29 of the slide plate 14a. This provides for two point contact for permanent securement of the adjustable mount into a fixed position. But, when the threaded shaft 19 biases against the back surface 29 of the slide plate 14*a*, it also provides for a snug engagement between the slide plate 14*a*, and the front surface 31 of the formed slots 20. This provides for two additional contacts, in the fixation of the adjustable mount. In addition, when tightening occurs, the block 13, at its back end, as can be seen, includes a pair of vertically arranged grooves 32. These grooves ride upon the complementary projecting surfaces 33 of the carrier 11. Hence, when tightening occurs, the projecting surfaces 33 become snuggly tightened within the vertical grooves 32, of the movable block 13, to provide for, what in essence, amounts to a six point contact for snug binding of the adjustable mount into a fixed position, once a fine and accurate setting has been made to the sighting device.

The foregoing provides an example as to how multiple integrated components may be fabricated to provide for convenience and the quick setting to the sight supported by an adjustable mount, but that once the sight has been fixed into an accurate and fine setting, the entire mount can be secured, to multipoint contact, to assure that the sight will remain fixed in its setting, even after repeated discharges of arrows, and exposure to the high impact and shear forces that are encountered, upon each shot or discharge.

Variations or modifications to the subject matter of this invention may occur to those skilled in the art upon reviewing the description of the invention as provided herein. Such variations or modifications, if within the spirit of this invention, are intended to be encompassed within the scope of any claims to patent protection issuing upon this development. The description of the preferred embodiment set forth herein, and as shown in the drawings, is provided for illustrative purposes only.

I claim:

1. A carrier for a bow sighting device comprising:

a) a hollow body having side walls spaced apart to define an elongated opening formed with guide tracks defining the opposite margins of said elongated opening and first grooves directed to extend along interiorly of said side walls;

b) bearing elements mounted in the opposite ends of said elongated openings in said hollow body;

c) a threaded shaft in said hollow body carried by said bearing elements to extend through said hollow body;

d) at least one rotating element on said hollow body proximate an end and connected to said shaft for rotating said threaded shaft;

e) a block having integral grooves in spaced relation to engage on said guide tracks for permitting said block to slide on said hollow body;

f) slide means in said hollow body engaged in said first grooves to be guided by said grooves during movement therein;

g) an actuator carried by said block and having one end engaged with said slide means and projecting into said hollow body and formed with an eye through which said threaded shaft extends, said eye being larger than said shaft and formed with thread elements to seat on said threaded shaft for moving said block along said guide tracks, said actuator having an opposite end projecting from said block;

h) a spring responsive element engaged on said opposite end of said actuator in position to releasably retain the thread elements of said eye of said actuator engaged with said threaded shaft to effect movement of said block upon shaft rotation, said spring responsive element being operable to release said eye engagement with said threaded shaft for movement of said block independently of shaft rotation; and i) whereby upon release of the actuator multipoint contact is made between the various hollow body guide tracks, the block, the slide means within the hollow body first grooves, and the threaded shaft against the slide block and the actuator eye threaded element.

2. A carrier for a bow sighting device comprising:

a hollow body having side walls spaced apart to define an elongated opening formed with guide tracks defining the opposite margins of said elongated opening provided along the length of the hollow body, bearing elements mounted in the opposite ends of said elongated opening in said hollow body, a threaded shaft in said hollow body carried by said bearing elements to extend through said hollow body, at least one rotating element on said hollow body connected to said shaft for rotating said shaft, a block having grooves in spaced relation to engage said hollow body for permitting said block to slide on said hollow body, slide means in said hollow body engaged in hollow body grooves to be guided by said grooves, an actuator carried by said block and having one end extending through said slide means and projecting into said hollow body formed with an eye through which said threaded shaft extends, said eye being larger than said shaft and formed with thread elements to seat on said threaded shaft for moving said block along said grooves, said actuator having an opposite end projecting from said block, a spring responsive element engaged on said opposite end of said actuator in position to releasably retain the threaded elements of said eye of said actuator engaged with said threaded shaft to effect movement of said block upon shaft rotation, said spring responsive element being operable to release said eye engagement with said shaft for rapid movement of said block independently of shaft rotation, and said spring biasing said actuator out of said block which when said actuator is tightened effecting a binding between the threaded shaft, the back of the eye of the actuator and against the slide means, and for binding said slide means against its grooves, and the block against the hollow body to sustain multipoint tightness for the bow sighting device once set.

3. In an adjustable bow sighting device, the improvement comprising:

a) a hollow body having a slotted side opening on said body, said slotted side being defined by tracks and adjacent slots;

b) a threaded shaft operably mounted in said hollow body to extend between the ends of said hollow body, and at least one rotating element on said hollow body connected to said shaft to provide rotation of said shaft;

c) a block formed with grooves adapted to engage on said body tracks for movement thereon relative to said hollow body and said threaded shaft;

d) a block moving actuator slidably carried in said block to extend into said hollow body, said actuator having an eye formed in one end to receive said threaded shaft therethrough and an opposite end projecting out of said body;

e) thread elements formed in at least a portion of said eye;

f) said hollow body having slots formed therein, and slide means in said hollow body engaged within said slots for sliding movement therein;

g) said slide means having an opening provided therethrough, and said actuator extending through said slide means opening;

h) a spring responsive element engaged on said opposite projecting end of said actuator in position to yieldably hold said eye threaded elements engaged with said threaded shaft whereby rotation of said threaded shaft slides said block on said hollow body; and i) manually operable means engage on said projecting end of said actuator for effecting disengagement of said eye threaded elements with said threaded shaft to allow for quick movement of said block independently of said threaded shaft rotation.

* * * * *